US006223633B1

(12) United States Patent
Chien-Chich

(10) Patent No.: US 6,223,633 B1
(45) Date of Patent: May 1, 2001

(54) SCREWDRIVER WITH CONTROL PORTION FOR SELECTIVELY RETAINING TIPS THEREIN

(76) Inventor: Chen Chien-Chich, P.O. Box 453, Taichung (TW)

( * ) Notice: Subject to any disclaimer, the term of this patent is extended or adjusted under 35 U.S.C. 154(b) by 0 days.

(21) Appl. No.: 09/429,663

(22) Filed: Oct. 29, 1999

(51) Int. Cl.[7] ..... B25B 23/00
(52) U.S. Cl. ..... 81/438; 279/79; 81/439
(58) Field of Search ..... 81/437–439, 177.85, 81/177.4, 490; 279/79, 84

(56) References Cited

U.S. PATENT DOCUMENTS 4,581,961 * 4/1986 Lai ..... 81/439
5,964,132 * 10/1999 Chen ..... 81/177.2 X

* cited by examiner

*Primary Examiner*—D.S. Meislin
(74) *Attorney, Agent, or Firm*—Harrison & Egbert

(57) ABSTRACT

A screwdriver having a handle and a tip detachably fastened to the handle. The handle has a control portion provided with a receiving hole in which the tip is releaseably retained by two retaining members in conjunction with a position confining block. A cover is fitted onto the end of the handle such that the tip extends through a through hole formed at a closed end of the cover. The position confining block extends partially outwardly through a through hole formed in a side wall of the cover.

2 Claims, 5 Drawing Sheets

SCREWDRIVER WITH CONTROL PORTION FOR SELECTIVELY RETAINING TIPS THEREIN

FIELD OF THE INVENTION

The present invention relates generally to a hand tool, and more particularly to a screwdriver.

BACKGROUND OF THE INVENTION

There are a variety of conventional screwdrivers, which are provided with various tips to use on a variety of screw heads. As a result, a worker has to carry a number of screwdrivers. This hampers the movement of the worker at the work site.

SUMMARY OF THE INVENTION

The primary objective of the present invention is to provide a screwdriver, which comprises a handle having a control portion for fastening detachably a tip in conjunction with two retaining members and a position confining block.

The foregoing objective, feature, and function of the present invention will be more readily understood upon a thoughtful deliberation of the following detailed description of a preferred embodiment of the present invention with reference to the accompanying drawings.

DETAILED DESCRIPTION OF THE PREFERRED EMBODIMENT

Figure 1:
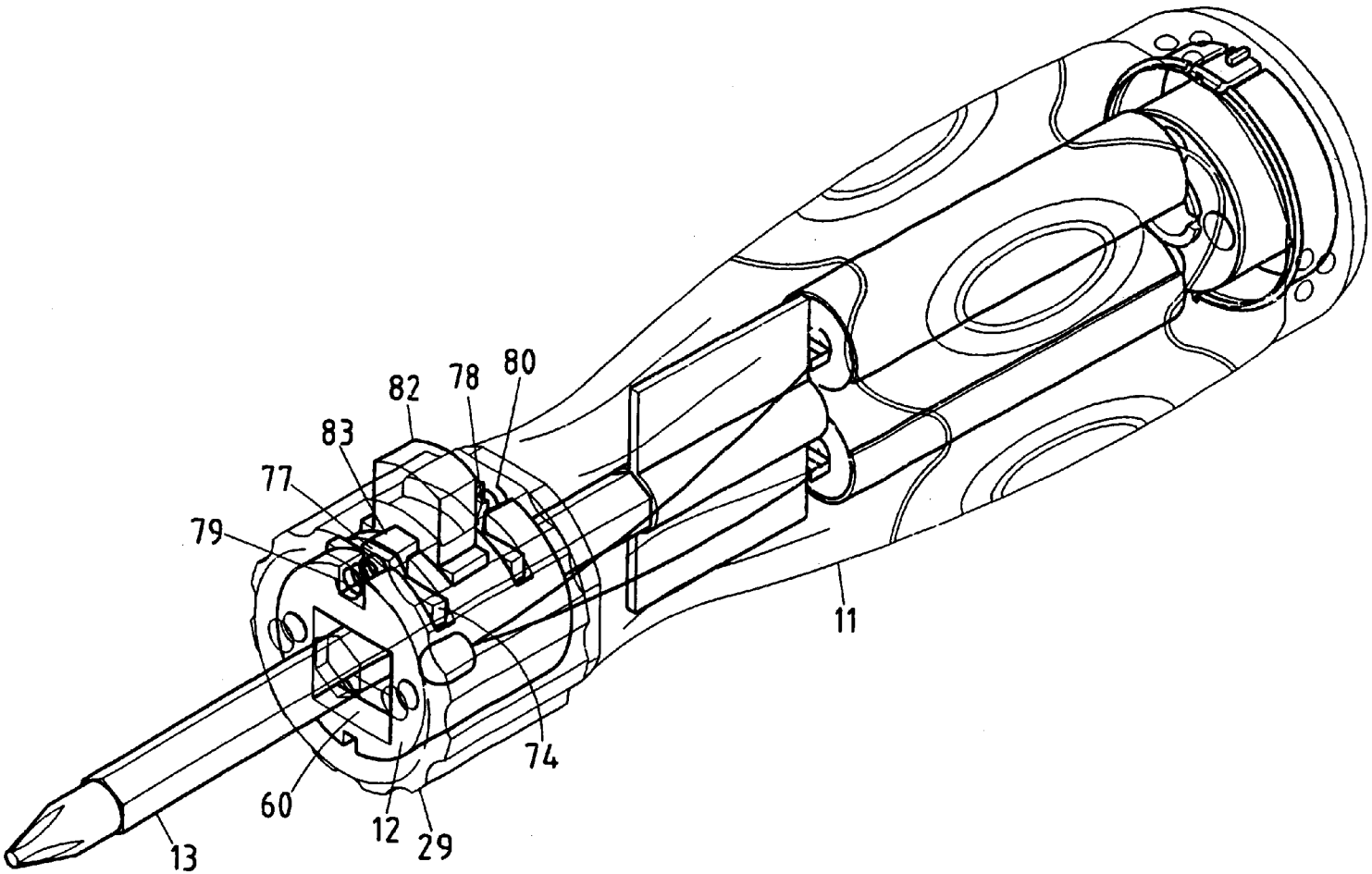
FIG. 1 shows a perspective view of the preferred embodiment of the present invention.
Figure 2:
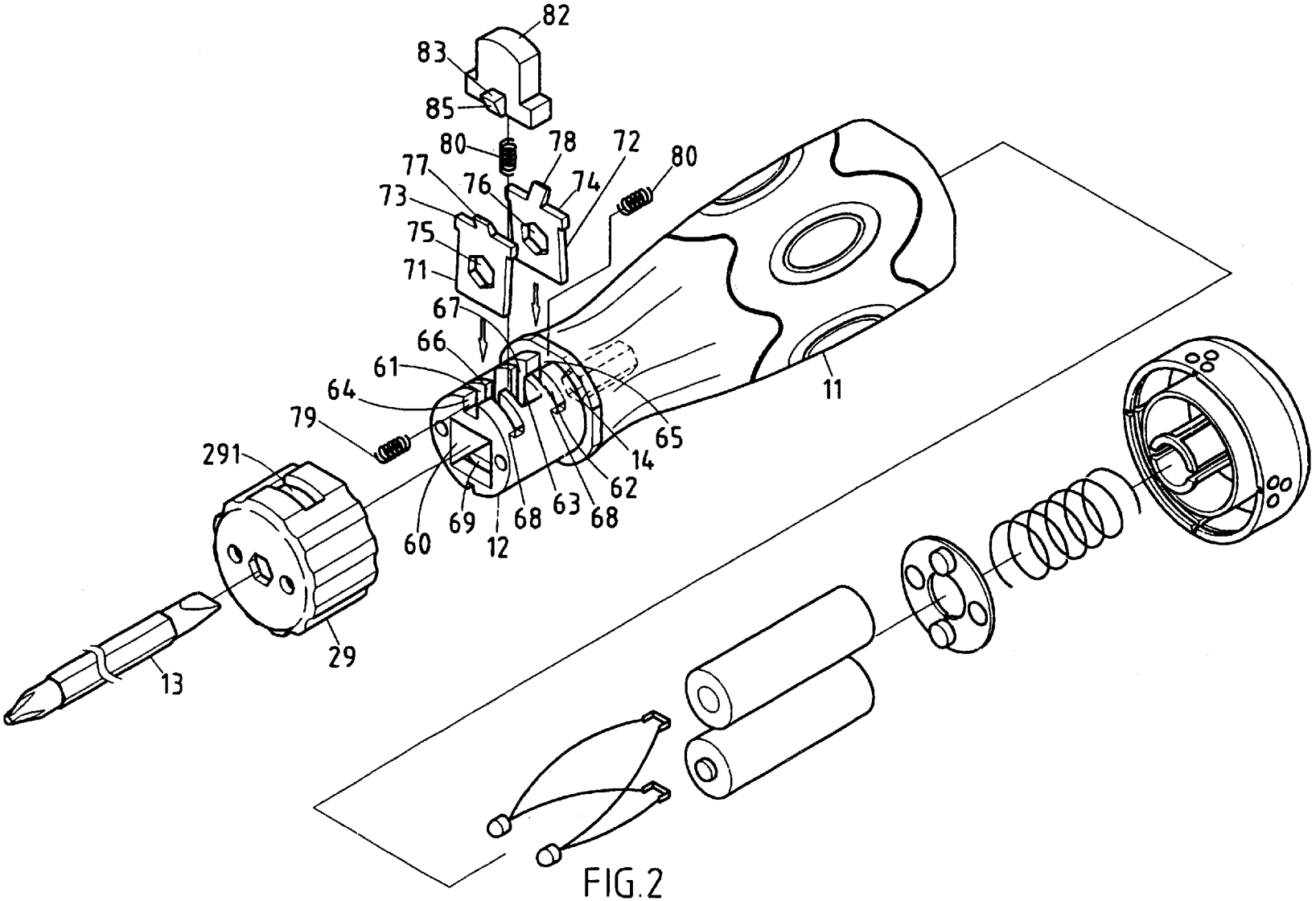
FIG. 2 shows an exploded view of the preferred embodiment of the present invention.
Figure 3:
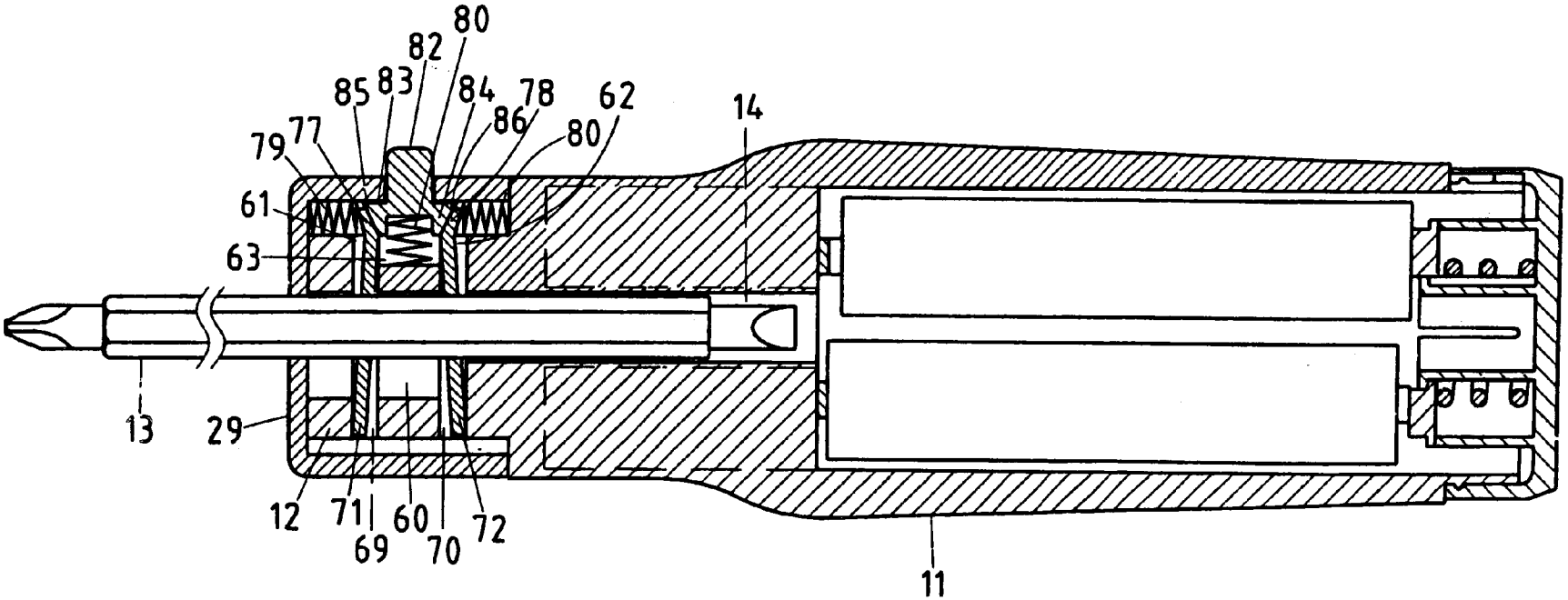
FIG. 3 shows a longitudinal sectional view of the preferred embodiment of the present invention in combination.

As shown in all drawings provided herewith, a screwdriver embodied in the present invention is essentially composed of a handle 11 and a plurality of tips 13.

The handle 11 is provided at the front end thereof with a control portion 12 for holding a tip 13 in conjunction with a first retaining member 71, a second retaining member 72, and a position controlling block 82.

The control portion 12 is provided with a receiving hole 14 of a predetermined depth and extending along the longitudinal direction of the control portion 12. The control portion 12 is further provided at the front end thereof with a receiving cell 60 in communication with the receiving hole 14. The control portion 12 is further provided in the outer wall thereof with a first slot 61 and a second slot 62, which are in communication with the receiving cell 60. A third slot 63 is located between the first slot 61 and the second slot 62. The first slot 61 is provided with an outer confining slot 64, whereas the second slot 62 is provided with an inner confining slot 65. The third slot 63 is provided with two guide holes 66 and 67, which are in communication with the first slot 61 and the second slot 62. The first and the second slots 61 and 62 are provided therein with a stepped edge 68. The control portion 12 is further provided in the outer wall thereof with a fourth slot 69 and a fifth slot 70, which are parallel to each other and opposite in location to the first slot 61 and the second slot 62. The fourth and the fifth slots 69 and 70 are in communication with the receiving cell 60.

The first retaining member 71 has a stop edge 73, a through hole 75, and an inclined guide piece 77. The first retaining member 71 is received in the first slot 61 such that the stop edge 73 of the first retaining member 71 is stopped by the stepped edge 68 of the first slot 61, and that the bottom of the first retaining member 71 is received in the fourth slot 69, and further that the center line of the through hole 75 of the first retaining member 71 is in common with the center line of the receiving hole 14.

The second retaining member 72 has a stop edge 74, a through hole 76, and an inclined guide piece 78. The second retaining member 72 is received in the second slot 62 such that the stop edge 74 is stopped by the stepped edge 68 of the second slot 62, and that the bottom of the second retaining member 72 is received in the fifth slot 70, and further that the through hole 76 shares the common center line with the through hole 75 and the receiving hole 14.

A first horizontal spring 79 is received in the outer confining slot 64. A second horizontal spring 80 is received in the inner confining slot 65. A vertical spring 80 is received in the third slot 63 before the position confining block 82 is received in the third slot 63 such that a first inclined surface 85 of a first guide block 83 of the position confining block 82 is in contact with the first inclined guide piece 77 of the first retaining member 71, and that a second inclined surface 86 of a second guide block 84 of the position confining block 82 comes in contact with the second inclined guide piece 78 of the second retaining member 72.

Figure 4:
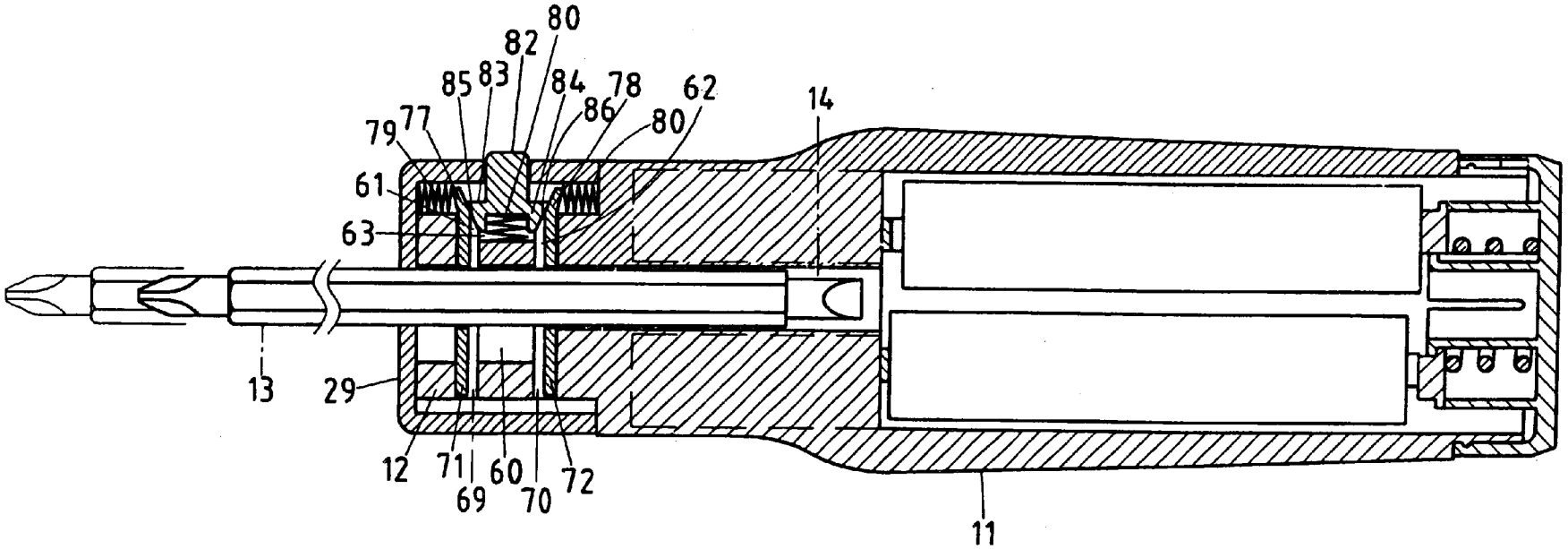
FIG. 4 is a longitudinal sectional view of the present invention to show the adjustment of the expandable tip.
Figure 5:
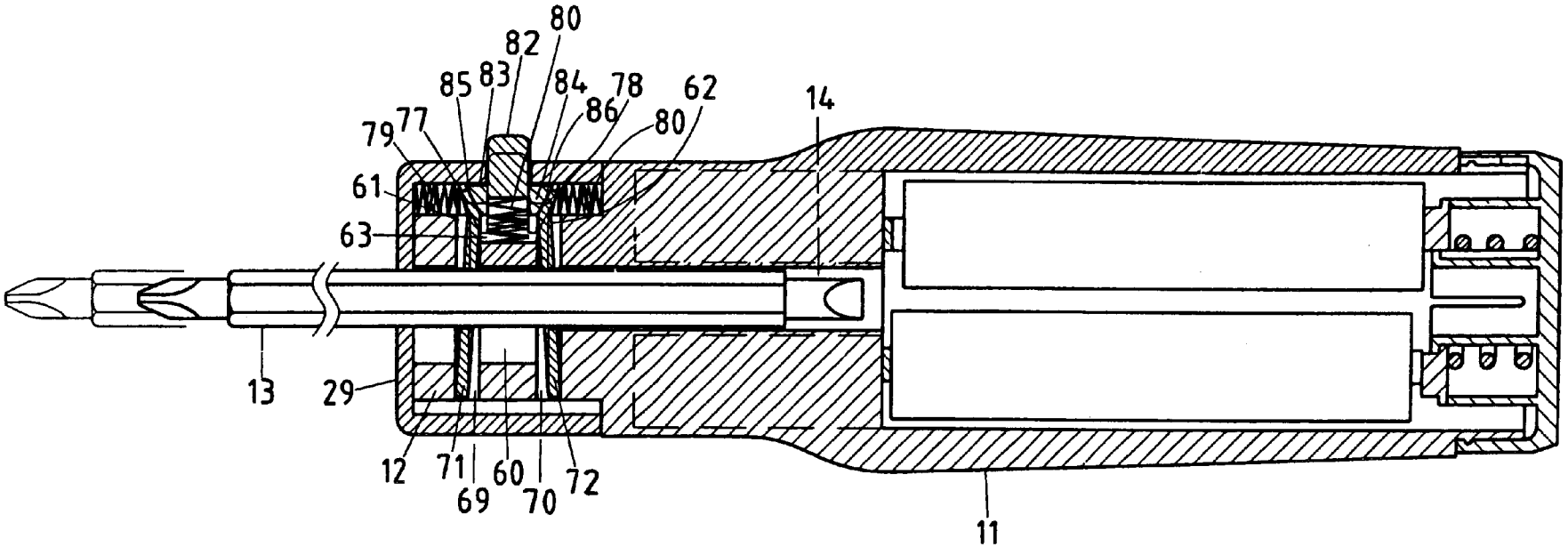
FIG. 5 shows a longitudinal sectional view of the preferred embodiment of the present invention in use.

The tip 13 is adjustably received in the receiving hole 14 and the receiving cell 60. Before inserting or adjusting the tip 13, the position confining block 82 is pressed to cause the inclined surfaces 85 and 86 of the guide blocks 83 and 84 of the position confining block 82 to push the two retaining members 71 and 72 such that the through holes 75 and 76 are properly aligned. As soon as the tip 13 is properly located or adjusted, the position confining block 82 is relieved of the external force applied thereto, thereby resulting in the position confining block 82 being urged back to its original position by the vertical spring 80. In the meantime, the inclined surfaces 85 and 86 of the position confining block 82 move away from the retaining members 71 and 72, which are subsequently pushed by the two horizontal springs 79 and 80 to tilt to enable the through holes 75 and 76 of the two retaining members 71 and 72 to retain the tip 13, as shown in FIG. 4.

The screwdriver of the present invention further comprises a cover 29 for shielding the control portion 12. The cover 29 is of a cylindrical construction and is provided in the side wall thereof with a through hole 291. The cover 29 has a closed end which is provided with a through hole for receiving the tip 13, and an open end from which the cover 29 is fitted over the control portion 12 such that the position confining block 82 extends partially outwardly of the through hole 291 of the cover 29.

What is claimed is:

1. A screwdriver comprising:

a tip; and a handle releasably fastened to said tip, said handle comprising:

a control portion positioned at one end of said handle, said control portion having a receiving hole extending along a longitudinal direction of said control portion, said receiving hole having a receiving cell being in communication with said receiving hole, said control portion having a first slot and a second slot and a third slot in an outer wall thereof, said third slot positioned between said first and second slots, said first and second slots being in communication with said receiving cell, said first slot having an outer confining slot, said second slot having an inner confining slot, said third slot having two guide holes respectively in communication with said first slot and said second slot, each of said first and second slots having a stepped edge, said control portion having a fourth slot and a fifth slot opposite in location respectively to said first slot and said second slot, said fourth and fifth slots being in communication with said receiving cell;

a first retaining member having a stop edge, a through hole and an inclined guide piece, said first retaining member being received in said first slot such that said stop edge is stopped by said stepped edge of said first slot, said first retaining member having a bottom received in said fourth slot, said through hole and said receiving hole having a common center line;

a second retaining member having a stop edge and a through hole and an inclined guide piece, said second retaining member being received in said second slot such that said stop edge of said second retaining member is stopped by said stepped edge of said second slot, said second retaining member having a bottom received in said fifth slot, said through hole of said second retaining member sharing a common center line with said through hole of said first retaining member and said receiving hole;

a position confining block having a first guide block having an inclined surface and a second guide block having an inclined surface, said position confining block is received in said third slot with a spring such that said inclined surface of said first guide block is in contact with said inclined guide piece of said first retaining member, said inclined surface of said second guide block is in contact with said inclined guide piece of said second retaining member;

a first horizontal spring received in said outer confining slot;

a second horizontal spring received in said inner confining slot, said position confining block movable by an external force to cause said inclined surfaces of said first and second guide blocks to respectively push said first retaining member and said second retaining member such that said through hole of said first retaining member is aligned with said through hole of said second retaining member so as to allow said tip to be received in said receiving hole and said receiving cell, said position confining block being movable upon release of the external force to a position whereby said inclined surfaces of said first and second guide blocks are moved away respectively from said first and second retaining members and whereby said first and second horizontal springs tilt respectively said first and second retaining members such that said through holes respectively of said first and second retaining members retain said tip in said receiving hole.

2. The screwdriver of claim 1, said handle further comprising:

a cylindrical cover having a through hole in a side wall thereof, said cover having a generally closed end with a through hole formed therein, said tip extending through said through hole of said closed end, said cover having an open end fitted over said control portion of said handle such that said position confining block extends partially outwardly through said side wall of said cover.

* * * * *